United States Patent [19]

Martel

[11] Patent Number: 4,958,572

[45] Date of Patent: Sep. 25, 1990

[54] NON-RICOCHETING PROJECTILE AND METHOD OF MAKING SAME

[75] Inventor: Yvan Martel, Loretteville, Canada

[73] Assignee: Her Majesty the Queen in Right of Canada, as represented by the Minister of National Defence of Her Majesty's Canadian Government, Canada

[21] Appl. No.: 406,304

[22] Filed: Sep. 12, 1989

[30] Foreign Application Priority Data

Feb. 24, 1989 [CA] Canada ..... 592121

[51] Int. Cl.[5] ..... F42B 13/20

[52] U.S. Cl. ..... 102/529; 102/506

[58] Field of Search ..... 102/529, 506, 502, 501

[56] References Cited

U.S. PATENT DOCUMENTS

| | | | |
|---|---|---|---|
| 2,442,155 | 5/1948 | Weese | 102/529 |
| 2,995,090 | 8/1961 | Daubenspeck | 102/529 |
| 3,123,003 | 3/1964 | Lange et al. | 102/529 |
| 3,385,215 | 5/1968 | Jungermann | 102/529 |
| 3,902,683 | 9/1975 | Bilsbury | 102/529 |
| 3,916,795 | 11/1975 | Lemstra | 102/529 |
| 4,165,692 | 8/1979 | Dufort | 102/529 |

*Primary Examiner*—David H. Brown

*Attorney, Agent, or Firm*—Stevens, Davis, Miller & Mosher

[57] ABSTRACT

A practice projectile for use with military aircraft and the like for training pilots in attacking ground targets comprises a unitary body formed of sintered sponge iron powder and having a sintered density equivalent to the apparent density of a projectile to be simulated.

10 Claims, 2 Drawing Sheets

NON-RICOCHETING PROJECTILE AND METHOD OF MAKING SAME

The present invention relates to a practice projectile or missile and, specifically, to a non-ricocheting practice projectile for aircraft.

BACKGROUND OF THE INVENTION

For several years, the Canadian Forces have been using the 20-mm M55A2 TP projectile for training pilots in attacking ground targets. The practice projectile consists of a main steel body having a copper driving band and an aluminum nose cap. Air operations, flight safety and technical staff of Air Command are becoming increasingly concerned with the ricochet hazards to aircraft during training gunnery missions, particularly when tactical target areas are used and also during the winter months when air weapon ranges cannot be sanitized of spent projectiles. Many Canadian Forces aircrafts have been damaged by projectile ricochet strikes resulting in a significant financial loss, not to mention the loss of operational aircraft during the period of repair, and the potential of destroying the aircraft and killing its air crew.

There is a need, therefore, for target practice projectile for air to ground use which will appreciably reduce, if not completely eliminate, the ricochet hazards to the aircraft during air to ground training gunnery missions. There are at least two ways of eliminating ricochet hazards. The first method is to have the projectile penetrate the target (in the present case, the ground) in which all of the energy of the projectile is dissipated during penetration. The second method is to have the projectile break-up on impact into relatively small fragments so that the non-aerodynamic shape of the fragments reduce the ricochet envelope and thus minimize the hazard to the aircraft.

Penetration of the projectile into the target is not always possible to achieve because of the high degree of obliquity used during air to ground gunnery missions where the dive angle can be as low as 5°. Also, the conditions of the ground impact area are not necessarily the same for different ranges and are greatly affected by the local meteorological conditions: the soil can be wet or dry, relatively hard or soft, frozen or it can be contaminated with pieces of rocks or spent projectiles. Because of all of these variables, it is virtually impossible to design a practice projectile that will always penetrate the target during air to ground training gunnery missions.

SUMMARY OF THE INVENTION

The present invention provides a frangible practice projectile manufactured by powder metallurgy techniques in such a manner that the projectile will sustain the load and stresses induced by gun launch and free flight but which will shatter at impact.

In accordance with one aspect of the present invention, there is provided a practice projectile for use with military aircraft and the like for training pilots in attacking ground targets, the projectile comprising a unitary body formed of sintered sponge iron powder and having a sintered density equivalent to the apparent density of a projectile to be simulated.

In accordance with another aspect of the present invention, there is provided a method of making a practice projectile for use with military aircraft and the like for training pilots in attacking ground targets. The method comprises the steps of compacting sponge iron powder in a mould having approximately the final shape of the projectile to form a cold compacted body, heating the cold compacted body in a furnace at a temperature which is less than the melting point of the powder for a predetermined time period of time in an atmosphere comprised of 95% Nitrogen and 5% Hydrogen to form a heated solid body, and allowing the heated solid body to cool in the furnace.

BRIEF DESCRIPTION OF THE DRAWINGS

These and other features of the invention will become more apparent from the following description in which reference is made to the appended drawing wherein.

DESCRIPTION OF PREFERRED EMBODIMENT

Figure 1:
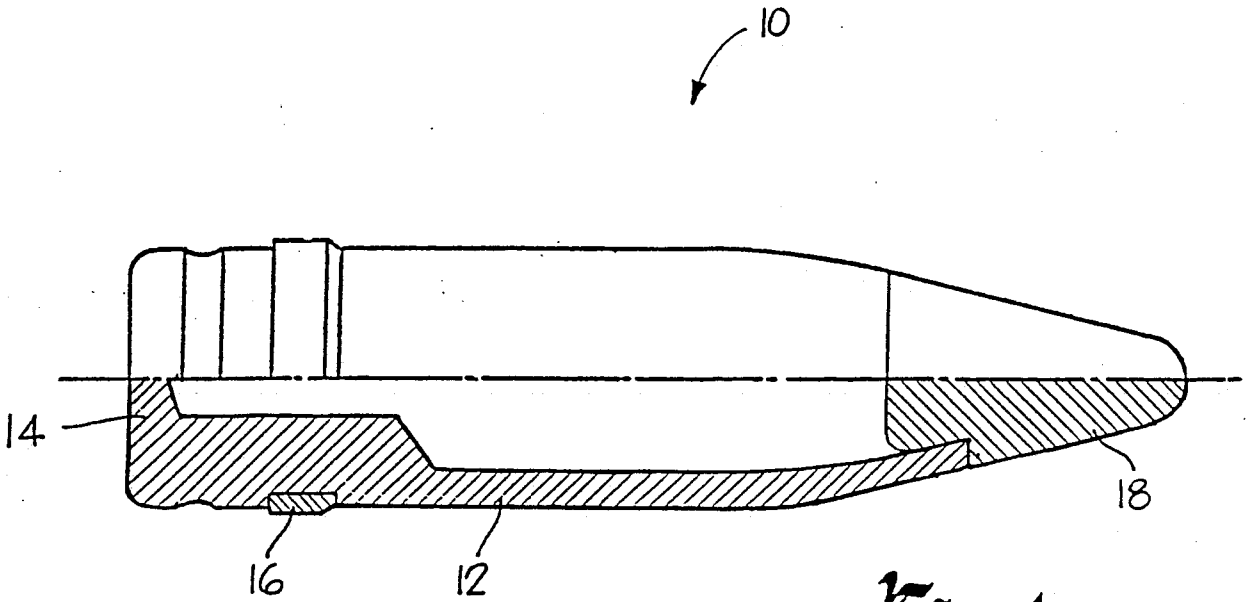
FIG. 1 is a side elevational view, partially in section, of an M55A2 20-mm conventional practice projectile.

FIG. 1 illustrates a standard M55A2 20-mm practice projectile 10 having a hollow steel body 12 and an integral base 14, a copper driving band 16 circumferentially crimped onto body 12 near base 14 and an aluminum nose 18 pressed into the open end of the body remote from the base. The apparent density of this projectile is about 5.35 g/cc. This target practice projectile is not designed to break-up upon impact; indeed, this type of structure is very resistant to compressive and tensile stresses. Theoretical analysis has shown that the compressive stresses imposed on the body are close to the yield strength of the material when the pressure behind the projectile reaches its maximum during launch but fall to almost zero in free flight. On the other hand, the tensile stresses increase with the spin rate and reach a maximum level at the muzzle of the gun; however, this is well below the yield strength of the material. This projectile has high ricochet characteristics and, therefore, is a potential hazard for aircraft firing them.

Figure 2:
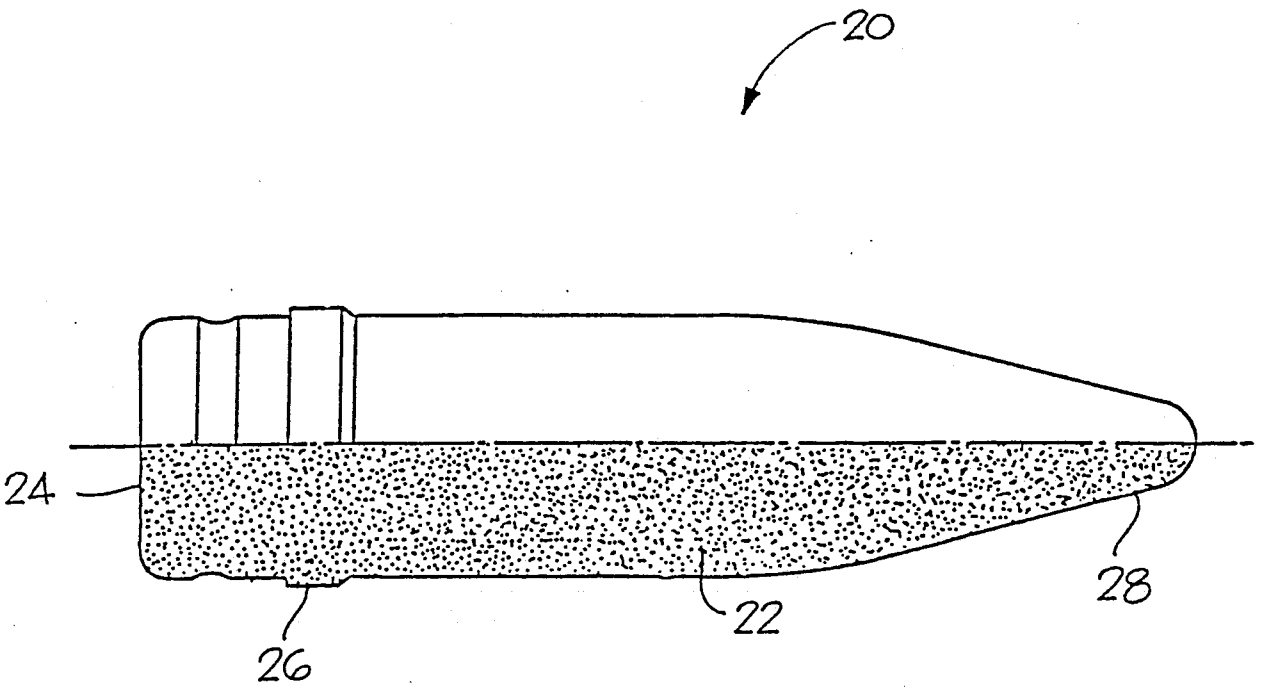
FIG. 2 is a side elevational view similar to FIG. 1 of a practice projectile according one embodiment of the present invention.

With reference to FIG. 2, the practice projectile 20 of the present invention comprises a unitary body 22, having an integral base 24, an integral circumferential driving band 26 near base 24 and an integral nose 28 at the end of the body remote from the base. Body 22 is a solid body having a uniformly distributed porosity throughout and is formed of sponge iron powder by an incomplete sintering process to the same size, shape and apparent density as the standard practice projectile described above.

The term "incomplete sintering" means that the sintering process is conducted at a temperature which is considerably lower than the melting point of iron powder, and, more generally, than the temperature at which iron powder is normally sintered. As a result, the iron particles are only partially consolidated. This characteristic coupled with the uniformly distributed porosity promotes fracture propagation on impact. The sintering temperature is selected so that the resulting body will have sufficient strength to withstand gun launch and free flight but promote fracture propagation on impact with even soft targets such as sand, a common medium employed to test ricochet occurrence.

Normally, iron powder components are sintered at about 1120° C. to reach a density of 7.0 to 7.5 g/cc which corresponds to 90–95% of the theoretical density of iron. In accordance with the present invention, for the specific practice projectile described above, the iron powder is heated at a temperature of 750° C. To make a projectile according to the present invention, a preweighted quantity of sponge iron powder is poured into a rubber or steel mould whose interior cavity has the desired shape of the projectile to be manufactured. The powder is compacted at 15,000 psi in an isostatic press if a rubber mould is used or in a uniaxial press if a steel mould is used. After de-moulding from either of the above moulds, the resulting "cold compact" is transferred into a conventional furnace and heated to a temperature of 750° C. for one hour in an atmosphere comprised of 95% Nitrogen and 5% Hydrogen. After allowing the "solid compact" to cool in the furnace, it is either sized in a press of finish machined to the final dimensions.

It will be understood that the present invention is not limited to the specific projectile illustrated in the drawings and described hereinabove.

The embodiments of the invention in which an exclusive property or privilege is claimed are defined as follows:

1. A practice projectile for use with military aircraft and the like for training pilots in attacking ground targets, said projectile comprising:

a unitary and solid body formed from sintered sponge iron powder having a uniformly distributed porosity throughout and having a sintered density equivalent to the apparent density of a projectile to be simulated.

2. A practice projectile as defined in claim 1, wherein said density equivalent to the apparent density is substantially less than the theorectical density of iron.

3. A practice projectile as defined in claim 1, said body having an integral nose.

4. A practice projectile as defined in claim 1, said body having an integral driving band.

5. A practice projectile as defined in claim 1, said body having an integral nose and driving band.

6. A practice projectile as defined in claim 1, said body having a uniformly distributed porosity for promoting fracture on impact.

7. A practice projectile for use with military aircraft and the like for training pilots in attacking ground targets, said projectile comprising:

a unitary and solid body having an integral nose and driving band and formed from sintered sponge iron powder having a sintered density equivalent to the apparent density of a projectile to be simulated and a uniformly distributed porosity for promoting fracture on impact.

8. A practice projectile as defined in claim 7, wherein said density equivalent to the apparent density is substantially less than the theorectical density of iron.

9. A practice projectile as defined in claim 1, said body being sintered at a temperature which only partially consolidates powder particles and provides sufficient strength to enable said body to sustain loads and stresses induced by gun launch and free flight while shattering on impact.

10. A practice projectile as defined in claim 9, wherein said temperature is 750° C.

* * * * *